US005956777A

United States Patent [19]

Popovich

[11] Patent Number: 5,956,777

[45] Date of Patent: Sep. 28, 1999

[54] HELMET

[75] Inventor: Darko D. Popovich, Phoenix, Ariz.

[73] Assignee: Grand Slam Cards, Scottsdale, Ariz.

[21] Appl. No.: 09/120,692

[22] Filed: Jul. 22, 1998

[51] Int. Cl.[6] ..... A42B 3/00

[52] U.S. Cl. ..... 2/424; 2/9; 2/412; 2/425

[58] Field of Search ..... 2/2.5, 9, 10, 410, 2/411, 412, 414, 424, 425, 463

[56] References Cited

U.S. PATENT DOCUMENTS

| | | | |
|---|---|---|---|
| 3,447,163 | 6/1969 | Bothwell | 2/3 |
| 3,577,836 | 5/1971 | Tamura | 2/2.5 |
| 4,075,717 | 2/1978 | Lemelson | 2/412 |
| 4,133,055 | 1/1979 | Zebuhr | 2/411 |
| 4,233,687 | 11/1980 | Lancellotti | 2/9 |
| 4,287,615 | 9/1981 | Morin | 2/424 |
| 4,345,338 | 8/1982 | Frieder, Jr. et al. | 2/414 |
| 4,370,759 | 2/1983 | Zide | 2/424 |
| 4,847,921 | 7/1989 | Leutholt et al. | 2/425 |
| 5,101,517 | 4/1992 | Douglas | 2/424 |
| 5,204,998 | 4/1993 | Liu | 2/411 |
| 5,412,814 | 5/1995 | Pernicka et al. | 2/424 |
| 5,561,866 | 10/1996 | Ross | 2/410 |
| 5,661,854 | 9/1997 | March, II | 2/410 |
| 5,669,079 | 9/1997 | Morgan | 2/414 |
| 5,687,426 | 11/1997 | Sperber | 2/411 |
| 5,713,082 | 2/1998 | Bassette et al. | 2/412 |
| 5,815,846 | 10/1998 | Calonge | 2/425 |

FOREIGN PATENT DOCUMENTS

| | | | |
|---|---|---|---|
| 7539620 | 12/1975 | France | 2/412 |

*Primary Examiner*—Michael A. Neas
*Assistant Examiner*—Gary L. Welch
*Attorney, Agent, or Firm*—Meschkow & Gresham, P.L.C.; Jordan M. Meschkow; Lowell W. Gresham

[57] ABSTRACT

A helmet assembly (20) for protecting a head and neck by laterally displacing impact forces (28). The helmet assembly (20) has a helmet (22) and a face guard (26). The helmet (22) has a rigid inner shell (96), a resilient spacing layer (94) outside of and in contact with the inner shell (96), an articulated shell (76) having a plurality of discrete rigid segments (78) disposed outside of and in contact with the resilient spacing layer (94), and a resilient outer shell (24) made of foam covered by an flexible protective layer (112). The face guard (26) has a plurality of transverse bars (36) with a longitudinal bar (38) down the center. The face guard (26) has shock absorbers (46) integrated on the lowermost transverse bar (36).

18 Claims, 4 Drawing Sheets

HELMET

TECHNICAL FIELD OF THE INVENTION

The present invention relates to the field of protective sports gear. Specifically, the present invention relates to protective helmets and face guards for sporting events.

BACKGROUND OF THE INVENTION

Conventional technology in the field of helmets is abundant. Types of helmets are chosen depending on their purpose. For example, helmets may be used in military and communications applications in addition to sporting events. In the sporting arena, helmets may be tailored to specialized events such as boxing, bicycling, motorcycling, flying, skydiving, baseball, canoeing, and the list goes on. Various events require helmets that protect an individual from multiple continuous impact forces or perhaps one debilitating impact force to the head and neck. The purpose of the helmet is to protect an individual, but, unfortunately the construction of the conventional helmet is not geared to protect based upon specific impact forces.

Types of helmets vary even more than the events for which they are used. Unfortunately, conventional helmet technology does not always effectively absorb impact forces, nor do they properly decelerate and spread forces laterally from the point of impact. Instead, the impact force too often goes directly through the helmet to the person's head and, in severe cases, down the person's spine, resulting in an injury. Conventional technology recognizes the need for padding within helmets for protection and comfort, but a detailed construction that allows the material make up of the helmet to shift and absorb continuous impact forces or one intense impact force is not sufficiently effective in conventional helmets.

Conventional technology also offers helmets with face guards. A face guard's main purpose is to allow a player to see and breathe, while simultaneously protecting the player. Unfortunately, face guards can be pulled, wrenched and twisted, resulting in neck injuries. Conventional technology offers face guards that break away after a predetermined amount of force is exerted. However, this predetermined force may change to a lesser force after repeated breaks from the helmet and become an annoyance. Moreover the predetermined force is usually set at a large value which may fail to protect a player from repeated experiences at a lesser force.

SUMMARY OF THE INVENTION

Accordingly, it is an advantage of the present invention that an improved shock-absorbing helmet and face guard is provided.

Another advantage is that the helmet laterally displaces impact forces.

Another advantage is that the face guard has shock absorbers to reduce the impact of push and pull forces.

The above and other advantages of the present invention are carried out in one form by a helmet for protecting a head by laterally displacing impact forces. The helmet has a rigid inner shell formed as a single unit and a resilient spacing layer outside of and in contact with the inner shell. An articulated shell that has a plurality of discrete rigid segments is disposed outside of and in contact with the resilient spacing layer.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
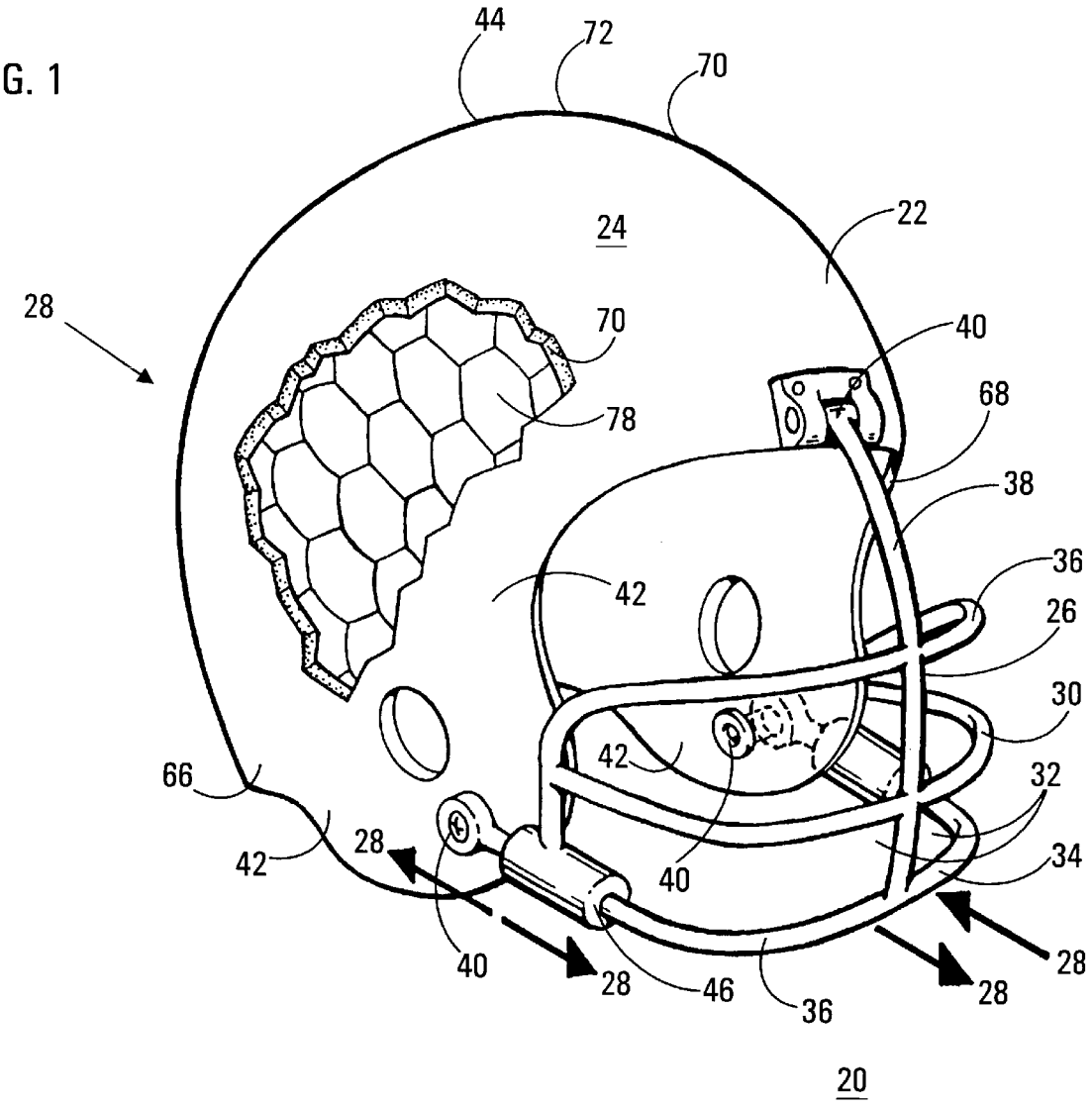
FIG. 1 shows a perspective view of a helmet assembly.

FIG. 1 shows a perspective view of a helmet assembly 20. Helmet assembly 20 includes a helmet 22 with a resilient outer shell 24 and a face guard 26. Helmet assembly 20 fits onto a person's head (not shown) to protect the person from impacting forces 28, specifically, but not limited to those experienced in football. Face guard 26 acts as a partition 30 between the person's face and anything that may harm the front, exposed portion of the head. Partition 30 has openings 32 which allow the person to see and breathe. Face guard 26 is made of a rigid material 34 which may be made of high density plastics for strength and weight concerns. Strength becomes a factor should the player be in a collision in which another player's helmet hits the player's face guard 26. Weight is a factor due to the length of time that a player wears helmet 22 during play. The lighter the material, the less strain is exerted on a players neck (not shown). Face guard 26 has a grid-like composition with several transverse bars 36. A singular longitudinal bar 38 bisects partition 30. Face guard 26 is coupled to resilient outer shell 24 by hinges 40 located on sides 42 and at top 44 of partition 30 on resilient outer shell 24. Hinges are used so that when face guard is hit, movement created by push and pull forces 28 are transferred into shock absorbers 46.

Figure 2:
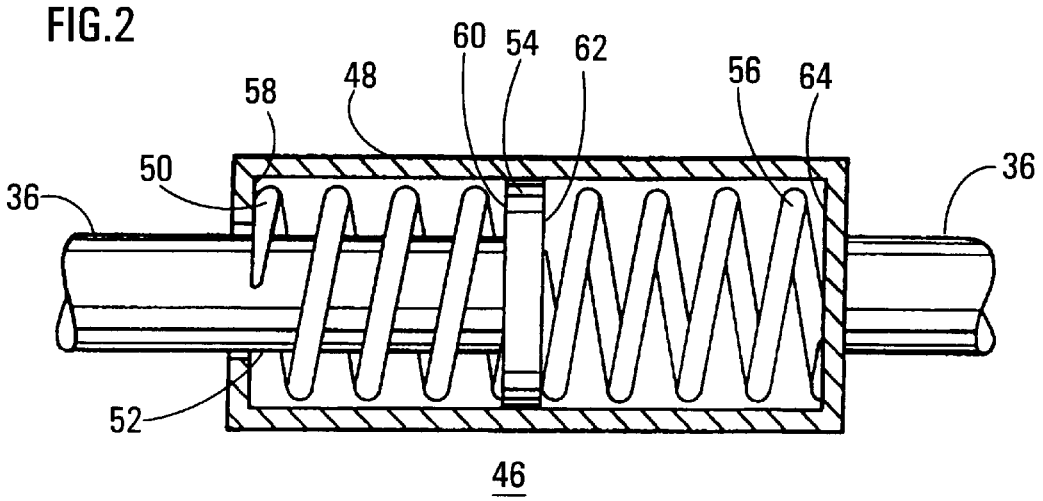
FIG. 2 shows a cross-sectional view of a shock absorber.

FIG. 2 illustrates an exploded cross-sectional view of a shock absorber 46. At least one shock absorber 46 is located on lowermost transverse bar 36 proximate and in front of side hinges 40 (FIG. 1) in the preferred embodiment. Shock absorber 46 is made up of a housing 48. Housing 48 is cylindrical in shape and is integrally a part of the lowermost transverse bar 36. Housing 48 is coupled to a first spring 50, a rod 52 which is coupled to a flange 54 and a second spring 56 with flange 54 disposed between first and second springs 50 and 56. Transverse bar 36 is an extension of rod 52. Transverse bar 36 passes through a first wall 58 of housing 48 then serves as rod 52. Rod 52, which is annular in shape, is located within housing 48 and couples to and terminates at a first side 60 of flange 54. Flange 54 is shaped like a penny (i.e., cylindrical and flat) and is situated between first and second springs 50 and 56. First spring 50 is a coil spring that is concentric with rod 52 within housing 48 until first spring 50 meets and couples with first side 60 of flange 54. On an opposite second side 62, flange 54 is coupled to second spring 56. Second spring 56 coils within housing 48 until it meets a second wall 64. Referring to FIG. 1, outside of housing 48, transverse bar 36 continues wrapping out and around from a first side 66 to a second opposite side 68 of helmet 22 to a second shock absorber 46. Each of shock absorbers 46 has a similar construction in the preferred embodiment. Transverse bars 36 jut out and around the face opening of assembly 20 to accommodate a players face.

Figure 3:
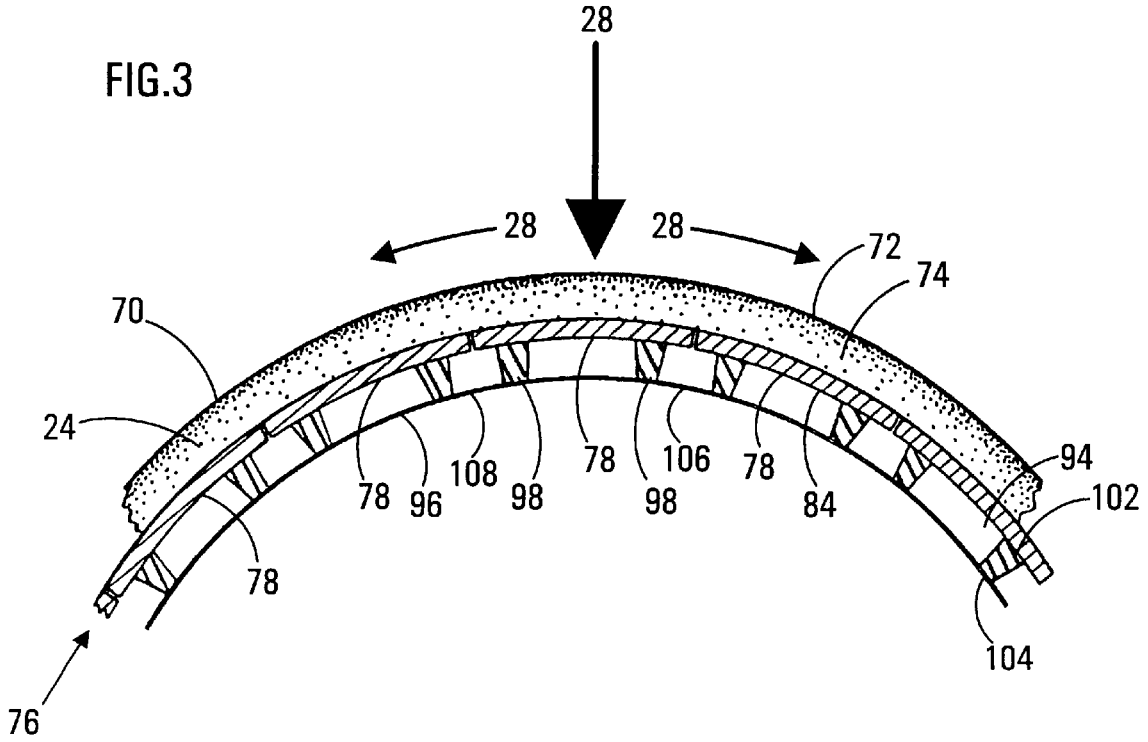
FIG. 3 shows a cross-sectional view of a portion of a helmet.

FIG. 3 illustrates a cross-sectional view of helmet 22 with four layers. The four layers include resilient outer shell 24, an articulated shell layer 76, a resilient spacing layer 94, and a rigid inner shell 96. Resilient outer shell 24 is padded but has a firm peripheral surface 70. Peripheral surface 70 is formed from a vinyl overlay 72 in the preferred embodiment. Immediately beneath vinyl overlay 72 is densely packed foam 74. The further away from vinyl overlay 72, the less dense foam 74 becomes. In other words resilient outer shell 24 becomes softer as the depth of foam 74 increases.

Figure 4:
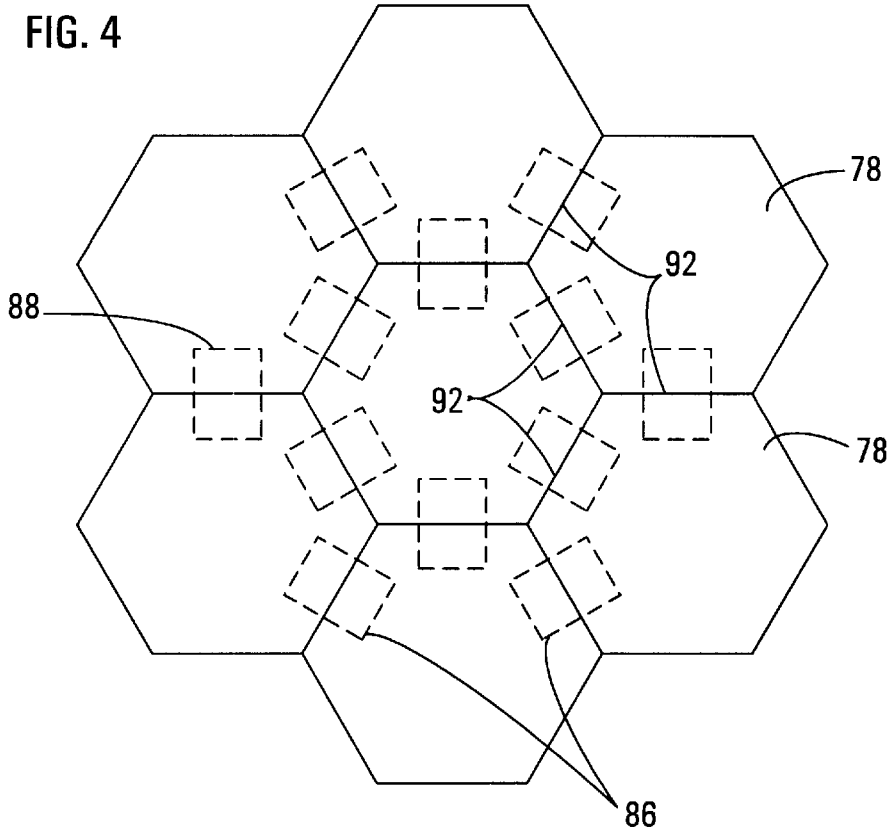
FIG. 4 shows a schematic view of discrete rigid segments.

Resilient outer shell 24 is proximate and comes in contact with articulated shell layer 76. Articulated shell layer 76 has a plurality of discrete rigid segments 78. FIG. 4 shows a schematic view of discrete rigid segments 78. Discrete rigid segments 78 are plates preferably in the shape of a hexagon. Hexagons are preferably ¾" to 1' in size. As illustrated in FIG. 3, discrete rigid segments 78 are curved like a lens having concave sides 84. Discrete rigid segments 78 are substantially inflexible in composition being preferably made of carbon fiber. Each discrete rigid segment 78 is connected to other rigid segments 78 by resilient members 86. Resilient members 86 may be elastic fiber bands 88, flexible elastic textile fabric, elastic sheet foam or other synthetic or natural rubber material. Resilient members 86, which are substantially rectangular in shape and are located on sides 92 of each segment 78, connect segments 78 to each other. Resilient members 86 may be inside or outside a single articulated shell layer 76. Around the edge of articulated layer 76 (not shown), resilient members 86 may be omitted or may couple edge segments 78 to resilient outer shell 24 or rigid inner shell 96. Concave sides 84 of discrete rigid segments 78 face resilient spacing layer 94 and rigid inner shell 96 illustrated in FIG. 3.

FIG. 3 illustrates resilient spacing layer 94 inside of and in contact with articulated shell layer 76. Pegs 98 are disposed within resilient spacing 94 layer. Pegs 98 are solid cylinders preferably made of latex, with outer portion 102 of pegs 98 touching hexagonal plates 80. Portion 102 has a predetermined circular surface area. Cylindrical pegs 98 taper down with bottom inner portion 104 touching inner rigid layer 96. Inner portion 104 has a lesser cross-sectional area than outer portion 102. In FIG. 3, rigid layer 96 is shown as being the innermost layer. A small number (e.g. 3–24) of pegs 98 are positioned between each discrete rigid segment 78 and the rigid inner shell 96. Resilient members 86 may be omitted all together so that discrete rigid segments 78 couple together through pegs 98. Rigid layer 96 is smooth, hard, and formed as a curved singular unit 106 so as to form around a players head. Rigid inner shell 96 is preferably made of a impact resistant plastic polymer such as a polyethylene or a plasticized polyvinylchloride. Rigid inner shell 96 has a concave side 108 that forms around the person's head.

Figure 5:
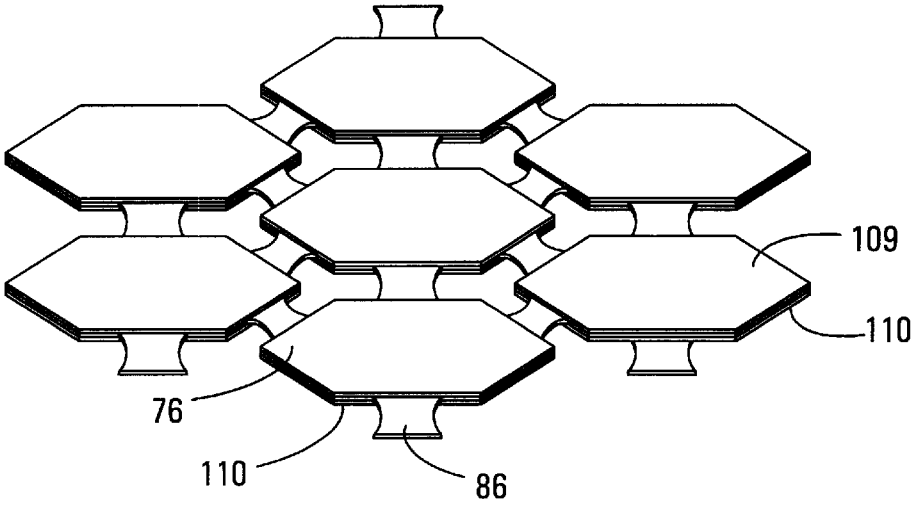
FIG. 5 shows a perspective, expanded of an articulated shell.

FIG. 5 shows a perspective, expanded view of resilient members 86 sandwiched between first and second articulated shells 109, and 110 in one embodiment of the invention. In this embodiment these three layers 109, 86 and 110, respectively, would be inserted between outer resilient outer shell layer 24 and resilient spacing layer 94. While not a requirement of the present invention, second articulated layer 110 affords more protection.

FIG. 1 illustrates exemplary push and pull forces 28 acting upon shock absorbers 46. Shock absorbers 46 are integrated within the lowermost transverse bar 36 of face guard 26. Shock absorbers 46 allow face guard 26 to be moved and at least partially absorbed by force 28 rather than transmit all of force 28 upon a neck (not shown).

In FIG. 3, direct and lateral impact forces 28 are illustrated acting upon helmet 20. Helmet 22 in turn, laterally displaces impact forces 28 by distributing them over a greater surface area. Forces 28 may be caused by the collision of helmet on helmet, body to helmet or helmet to ground, all at accelerated speeds experienced during sports play, specifically football.

Impact forces 28 may manifest themselves in an elastic or an inelastic collision. Elastic collisions occur when two objects colliding have the same kinetic energy before and after the collision as when two billiard balls collide. Inelastic collisions are when the final kinetic energy is greater than the initial kinetic energy as when two balls of putty collide and stick together.

Upon impact, both objects are deformed because of the strength of the forces involved. Depending on the composition of the objects and the amount of force 28, the deformity may be temporary or permanent. The magnitude of force 28 as a function of time is known as impulse on the head and neck. The construction of helmet assembly 20 laterally dissipates impact forces in order to weaken the impulse, thereby protecting the player from injury. Because football is a sport where impacts are plentiful and continuous, helmet 22 must also have the ability to sustain impact after impact without cracking, breaking down, or losing its ability to dissipate impact forces.

In FIG. 3, forces 28 are illustrated as they spread laterally from a point of impact throughout helmet 22. Resilient outer shell 24 has an initial resistance and then it absorbs a first portion of force 28 within itself. Upon initial contact, outer shell 24 exerts great resistance which lessens as the force is absorbed into the less densely packed foam 74. Resilient outer shell 24 acts as a flexible protective layer for foam 74. A remaining portion of force 28 is then transmitted to articulated shell layer 76. In conjunction with elastic bands 88 and pegs 98, compression causes pegs 98 to press upon elastic bands 88. Elastic bands 88 pull upon and the hexagonal configuration promotes the pull of adjoining plates. This pull and resulting displacement of segments 78 against resilient elastic bands 88 and pegs 98 further dissipates the impact.

Figure 6:
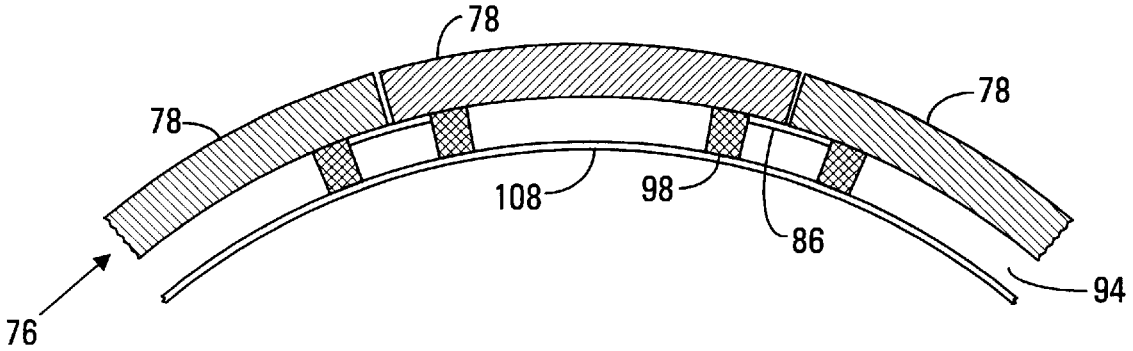
FIG. 6 shows a first cross-sectional view of a portion of the helmet.
Figure 7:
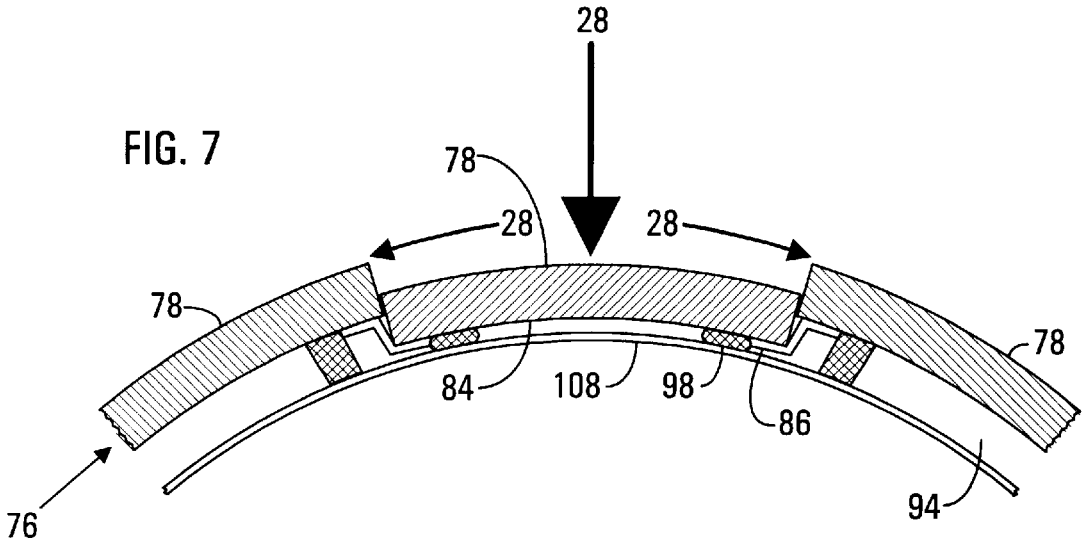
FIG. 7 shows a second cross-sectional view of the portion of the helmet.

In particular, forces 28 pull from one hexagon to another across an entire surface area 70 of helmet 22. Because segments 78 are articulated and not rigidly attached or united, force 28 is better dissipated by overcoming one displacement after another between segments 78. Discrete rigid segments 78 serve another function because of their ability to compress toward inner shell 96. FIG. 6 illustrates articulated layer 76 over resilient spacing layer 94 when no impact is applied to helmet 22. FIG. 7 illustrates the same except that a hexagonal segment 78 is being compressed into resilient spacing layer 94, forcing pegs 98 to distort and compress. Space in spacing layer 94 permits significant temporary displacement of segments 78 from their normal position, which leads to the greater impact dissipation and deflection. Force 28 is further dissipated when pegs 98 compress and shift within resilient spacing layer 94. This enhanced impact dissipation is needed prior to being transmitted to the innermost rigid shell 96 which is the players last line of defense.

Additional layers may be added outside resilient outer shell 24 or inside inner shell 96. Inside layers may be desirable for comfort and to adopt a helmet to an individual's head shape.

In summary, an improved shock absorbing helmet is provided. The present invention laterally displaces impact forces which may cause serious damage to the head. The shock absorbers integrated into the face guard reduces push and pull forces that cause injury to the neck.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A helmet for protecting a head by laterally displacing impact forces, said helmet comprising:

a rigid inner shell formed as a single unit;

a resilient spacing layer disposed outside of and in contact with said inner shell; and an articulated shell having a plurality of discrete rigid segments disposed outside of and in contact with said resilient spacing layer and a plurality of resilient members which couple adjacent ones of said rigid segments to one another.

2. A helmet as claimed in claimed 1 wherein:

each of said discrete rigid segments is formed substantially in the shape of a hexagon.

3. A helmet as claimed in claim 1 wherein:

each of said discrete rigid segments has a concave side facing said rigid inner shell.

4. A helmet as claimed in claim 1 wherein:

each of said discrete rigid segments is a plate.

5. A helmet as claimed in claim 1 wherein said resilient spacing layer comprises a plurality of resilient pegs configured so that each segment of said articulated shell contacts a portion of said pegs.

6. A helmet as claimed in claim 5 wherein: said pegs are formed from latex.

7. A helmet as claimed in claim 1 wherein:

said resilient members are elastic fabric bands.

8. A helmet as claimed in claim 1 wherein:

said articulated shell is a first articulated shell, said helmet additionally comprises a second articulated shell disposed outside of said first articulated shell, said second articulated shell having a plurality of discrete rigid segments, and said resilient members being disposed between said first and second articulated shells.

9. A helmet as claimed in claim 1 additionally comprising a foam layer disposed outside said articulated shell, said foam layer being covered by an outer flexible protective layer.

10. A helmet as claimed in claim 9 wherein:

said foam is more compact when proximate a vinyl overlay; and said foam is less compact when not proximate said vinyl overlay.

11. A helmet as claimed in claim 1 additionally comprising a face guard, said face guard being hingedly coupled to said helmet.

12. A helmet as claimed in claim 1 additionally comprising a face guard, wherein said face guard additionally comprises a shock absorber.

13. A helmet as claimed in claim 12 wherein:

said shock absorber comprises a housing coupled to a first spring, a rod coupled to a flange, and a second spring wherein said flange is disposed between said first and second springs.

14. A helmet for protecting a head and neck from face guard-applied push and pull forces, said helmet comprising:

a shell; and a face guard coupled to said shell, said face guard having at least one integral shock absorber, said shock absorber comprising a housing coupled to a first spring, a rod coupled to a flange, and a second spring wherein said flange is disposed between said first and second springs.

15. A helmet as claimed in claim 14 wherein:

said face guard is hingedly coupled to said shell.

16. A helmet as claimed in claim 14 wherein said shock absorber additionally comprises hinges, said hinges being located on sides of said face guard.

17. A helmet for protecting a head by laterally displacing impact forces, said helmet comprising:

a rigid inner shell formed as a single unit;

a resilient spacing layer having of a plurality of resilient pegs disposed outside of and in contact with said inner shell;

an articulated shell having a plurality of discrete rigid segments formed substantially in the shape of hexagons disposed outside of and in contact with said resilient spacing layer, said articulated shell further having elastic fabric bands coupling adjacent ones of said segments to one another;

a resilient outer shell made of foam with a vinyl overlay, said resilient outer shell being outside of said articulated shell; and a face guard having an integral shock absorber, said face guard being coupled to said resilient outer shell.

18. A helmet as claimed in claim 17 wherein:

said face guard is a partition with openings.

* * * * *